US008047926B2

(12) United States Patent
Chen

(10) Patent No.: US 8,047,926 B2
(45) Date of Patent: Nov. 1, 2011

(54) FLUID CHAMBER INFLATABLE APPARATUS

(76) Inventor: Samuel Chen, Hong Kong (CN)

( * ) Notice: Subject to any disclaimer, the term of this patent is extended or adjusted under 35 U.S.C. 154(b) by 462 days.

(21) Appl. No.: 12/319,201

(22) Filed: Jan. 2, 2009

(65) Prior Publication Data

US 2009/0264042 A1 Oct. 22, 2009

Related U.S. Application Data

(63) Continuation-in-part of application No. 12/148,369, filed on Apr. 19, 2008.

(51) Int. Cl.
*A63G 31/12* (2006.01)
*A63B 9/00* (2006.01)

(52) U.S. Cl. ..... 472/134; 482/35

(58) Field of Classification Search ..... 472/116, 472/117, 134, 136; 482/23, 27, 35–37
See application file for complete search history.

(56) References Cited

U.S. PATENT DOCUMENTS 4,546,965 A * 10/1985 Baxter et al. ..... 482/35
5,462,505 A * 10/1995 Blair et al. ..... 482/27
5,772,535 A * 6/1998 Murphy ..... 473/415
6,193,633 B1 * 2/2001 Jonas et al. ..... 482/35
6,364,782 B1 * 4/2002 Ochi ..... 472/134
6,659,914 B2 * 12/2003 Plante ..... 482/27
6,679,811 B2 * 1/2004 Chen ..... 482/29
7,311,610 B2 * 12/2007 Ochi ..... 472/134

* cited by examiner

*Primary Examiner* — Kien Nguyen
(74) *Attorney, Agent, or Firm* — Clement Cheng

(57) ABSTRACT

The present invention is an inflatable apparatus that has a fluid chamber. The inflatable side air chamber surrounds the fluid chamber. The inflatable side air chamber forms a fluid chamber pocket for receiving the fluid chamber. A sidewall of the inflatable side air chamber has retaining walls extending upward from the inflatable side air chamber for retaining children. A fill tube is disposed on the fluid chamber. An optional inflatable ramp adjacent to the fluid chamber leads to a slide for sliding to a slide exit. The ramp may have hand grips formed as straps and footholds may also be formed on the ramp. The retaining walls can be inflatable sidewalls that extend upward from the inflatable side air chamber.

6 Claims, 4 Drawing Sheets

FLUID CHAMBER INFLATABLE APPARATUS

This application is a continuation in part of co-pending U.S. patent application Ser. No. 12/148,369 entitled Water Conservation Pool, filed Apr. 19, 2008 to inventor Samuel Chen, the entire disclosure of which is incorporated herein by reference.

FIELD OF THE INVENTION

The invention is in the field of recreational and entertainment jumpers and inflatables.

DISCUSSION OF RELATED ART

The backyard inflatable jumper or slide has become a part of the American landscape and also in suburbs everywhere around the world. Whether they are permanent such that they are like a part of the yard, or whether they are rented for the day, these jumpers have become ubiquitous. Children enjoy spending lazy summers jumping in a bounce house and literally bouncing off the walls. Other types of jumping fun would include the backyard trampoline. The backyard fun also continues with swimming pools and aboveground pools on hot summer days.

In recent years, the size of the jumpers has increased to accommodate more kids. Larger jumpers also accommodate larger kids and adults. A variety of safety features have been invented to make the inflatable industry safer. Some of these inflatable jumpers are about 20 feet tall, tall enough to catch the wind. To stabilize the jumpers, a wide variety of stabilizing methods have been created, such as inventor Samuel Chen's U.S. Pat. No. 6,648,767 issued Nov. 18, 2003, the disclosure of which is incorporated herein by reference. In the '767 patent, the inflatable waterslide used side stabilizing chambers. Other safety features have made jumpers acceptable to parents to such an extent that parents are generally comfortable that their children are safe when inside a bounce house, or on an inflatable slide.

While the industry has become safer, and products have become better designed, the ubiquitous nature of inflatables has worn off some of the fun factor. Today, a wide variety of different ornamental designs have been made for jumpers, and slides commonly found at children's birthday parties and in suburb backyards. Many of the different ornamental designs are based on themes, such as based on commonly known licensed characters or generic themes such as dinosaurs, clowns or haunted house. Still, many of the backyard bouncers and slides have become ordinary and it is not that big a deal anymore to get a jumper rental for your kid's birthday party. Thus, there is a need in the industry to provide a fundamentally different structure so as to continue to capture the imagination of children and bring back some of the wow that the recreational entertainment inflatable structure industry had so much of in its early infancy.

Therefore, it is an object of this invention to provide a fun and exciting backyard inflatable structure that provides a safe yet new experience for kids to enjoy.

SUMMARY OF THE INVENTION

The present invention has a fluid chamber which is preferably filled with water, and having an air gap at the top. Articles such as balls or other decorative small plastic items can be floating around in the water. The fluid chamber has a transparent top for viewing inside. The fluid chamber has great mass that presses it against the ground. The fluid chamber is made of a number of panels of plastic, such as PVC. The plastic panels retain the water within the chamber. The chamber is flexible to allow children to jump on top and to look at the splashing of the water and the movement of the decorative articles floating around inside.

The fluid chamber is supported and bounded by a side air chamber having no fluid communication with the fluid chamber. The side air chamber can be inflated by a constantly blowing fan or with trapped air in a cold air configuration. The constantly blowing fan is preferable for large scale units.

The side air chamber preferably has bounding mesh panels that provide at least a partial enclosure. As an alternative to mesh panels, inflatable sidewalls can also be implemented. The sidewalls can be sloped to form a ramp, for climbing. A ramp can have a number of handgrips and footholds, and allow children to climb up to a slide for sliding down. A slide exit receives the children and directs them back to the fluid chamber for additional bouncing fun.

The mesh panels are preferably supported by an inflatable column, and can also be supported by a support pole. The support pole is preferably constructed of a hollow tube of steel or fiberglass and wrapped with a plastic foam cushion covering.

The fluid chamber fits into a fluid chamber pocket that is formed into the side air chamber. The side air chamber has a depression to form a pocket for receiving the fluid chamber such that the weight of the fluid chamber rests on the ground and retains the side air chamber to the ground. The fluid chamber stabilizes the side air chamber with its weight. The side air chamber may have a bottom panel that is not inflated, but which extends underneath the fluid chamber, and extends between the walls of the side air chamber.

A passage may be formed through the side air chamber, through the fluid chamber pocket for filling and discharging the water in the fluid chamber. A fill tube connected to the fluid chamber allows a user to drain and fill the fluid chamber preferably with a garden hose connection. When the apparatus is set up, the operator initially sets up the side air chamber and inflates it, then inserts an empty watertight fluid chamber into the fluid chamber pocket, then fills the fluid chamber. After the event, the operator may leave the apparatus in place for the next event, or drain the fluid chamber through the fill tube and remove the fluid chamber before stowing the side air chamber.

The following call out list of elements provides a reference for reviewing the drawings and understanding how all of the parts relate to each other.

28 Mesh Wall Panel
35 Fan
54 Vertical Column
55 Horizontal Inflatable Member
56 Zippered Door
58 Inside Bounce Surface
59 Outside Surface
65 Side Air Chamber
71 Trampoline Bed

72 Trampoline Frame
73 Trampoline Skirt
74 Support Post
78 Trampoline Mesh Panel
86 Water
87 Air
88 Fluid Chamber
82 Decorative Articles
89 Transparent Top
91 Handgrip
92 Foothold
93 Canopy
94 Canopy Mesh
95 Slide
96 Ramp
98 Sidewalls
99 Slide Exit
121 Fill Tube
122 Passage
188 Fluid Chamber Pocket

DETAILED DESCRIPTION OF THE PREFERRED EMBODIMENT

Figure 1:
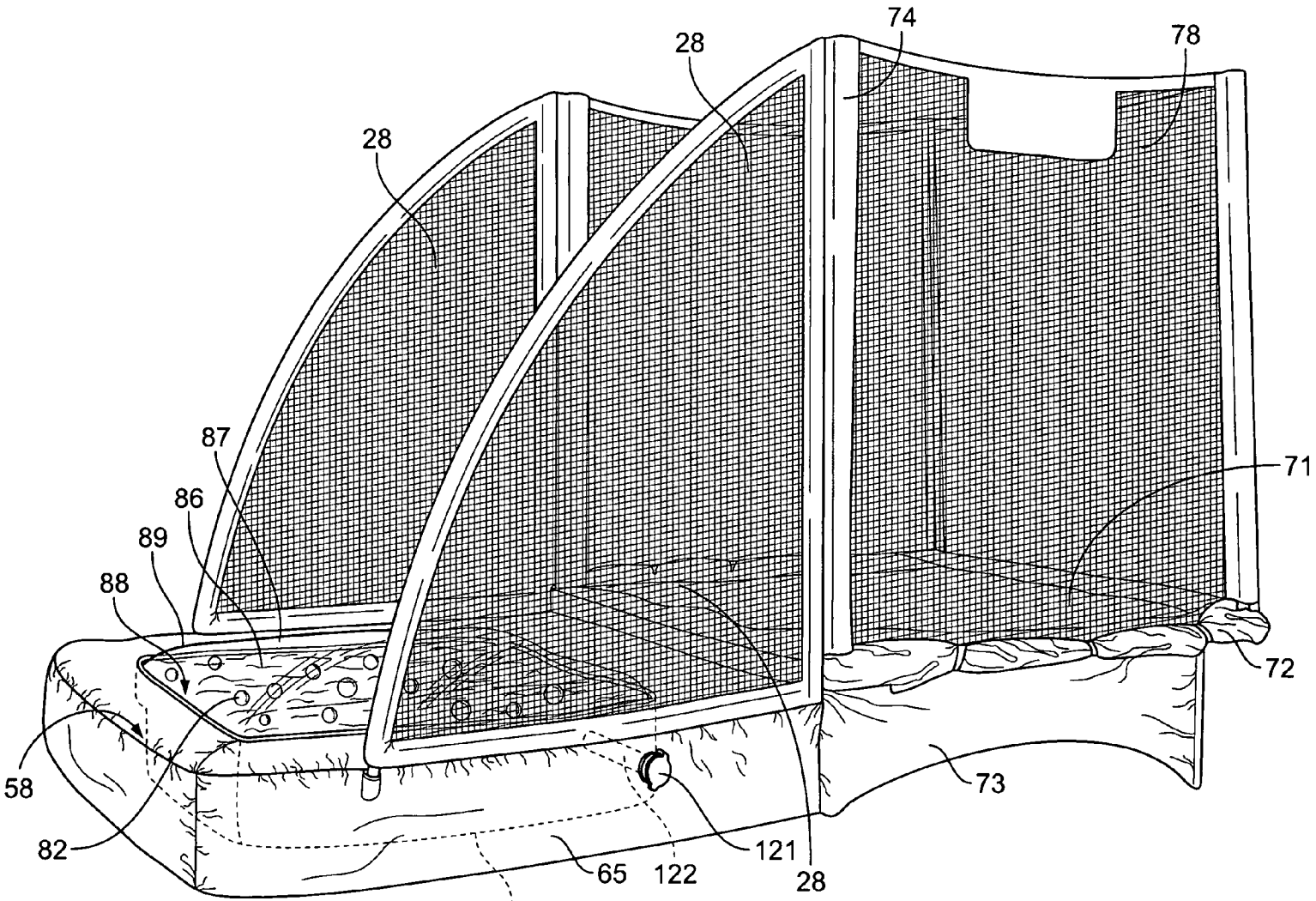
FIG. 1 is a perspective view of the fluid chamber jumper trampoline embodiment.

As seen in FIG. 1, the apparatus is deployed on the ground. The present invention has a fluid chamber 88 which is preferably filled with water 86, and having an air gap 87 at the top. Decorative articles 82 such as balls or other decorative small plastic items like action figures or motion activated blinking light baubles can be floating around in the water. The decorative articles 82 can be selected according to a theme or can be a random array of color. The fluid chamber has a transparent top for viewing the decorative articles inside. Some of the decorative articles 82 can be made to float, while others have varying degrees of buoyancy. Alternatively, a fluid such as fine sand or oil can be mixed into the water 86 for additional special effects. It is preferred that in the case of introducing fine sand into the fluid chamber, that the color of the sand have color contrast with the color of the bottom of the fluid chamber to provide additional contrast. The bottom of the fluid chamber 88 and the bottom panel of the side air chamber 65 forming the fluid chamber pocket 188 are optionally transparent to allow children to see the ground.

The fluid chamber mass weighs on the ground and conforms to the shape of the ground. The fluid chamber is made of a number of panels of plastic, such as PVC and is shown as a rectangular object in FIG. 1. The plastic panels retain the water within the chamber so that the fluid chamber 88 is watertight. The fluid chamber is flexible enough to allow children to jump on top and to look at the splashing of the water and the movement of the decorative articles moving about inside. The fluid chamber 88 may also bulge up in the middle from the air layer 87 above the water 86. The air layer 87 can be minimal so that there are only bubbles floating about the transparent top 89. The air layer 87 can also be substantial enough to have a bulge as seen in FIG. 1. The bulge of the air layer pushes the transparent top layer 89 above the inside bounce surface 58 of the side air chamber 65.

The fluid chamber 88 is supported and bounded by a side air chamber 65, which has no fluid communication with the fluid chamber. The side air chamber 65 can be inflated by a constantly blowing fan 35, FIG. 2 or with trapped air in a cold air configuration. The constantly blowing fan 35 is preferable for larger units FIGS. 2, 3. The constantly blowing fan blows air into the side air chamber 65, making the side air chamber 65 rigid. The rigid side air chamber 65 assists and supports the structure of the fluid chamber 88. The side air chamber 65 preferably presses around the edges of the fluid chamber 88 on all sides.

The side air chamber preferably has bounding mesh panels 28 that provide at least a partial enclosure. The side air chamber 65 has an inside bounce surface 58 which is located within the bounding mesh panels 28. An outside surface 59 is defined as the area of the side air chamber 65 that is outside the bounding mesh panels 28. The mesh panels 28 are breathable, and see through, and can also be made as a coarse as a net. The mesh panels are attached to supporting structures. As an alternative to mesh panels, inflatable sidewalls 98, FIG. 3 can also be implemented, both of which are retaining walls. The retaining walls extend upward from the inflatable side air chamber. The sidewalls 98 can be sloped to form a ramp 96 of approximately 45° angle, for recreational climbing. A ramp 96 can have a number of handgrips 91 and footholds 92, and allow children to climb up to a slide 95 for sliding down into a slide exit 99. The handgrips 91 are formed as straps, and the footholds 92 are formed as depressions into the ramp 96. A slide exit 99 receives the children and directs them back to the area of the fluid chamber 88 for additional bouncing fun. The top of the slide embodiment is preferably enclosed in a canopy 93, which can be made of inflatable structure. The canopy 93 preferably includes a canopy mesh 94 to retain children inside the safe area of the inflatable structure. The fluid chamber 88 of the slide embodiment acts as a base from which to begin climbing the ramp. The fluid chamber 88 of the slide embodiment is bounded by sidewalls 98 and side air chamber 65 from which the sidewalls extend up.

Figure 2:
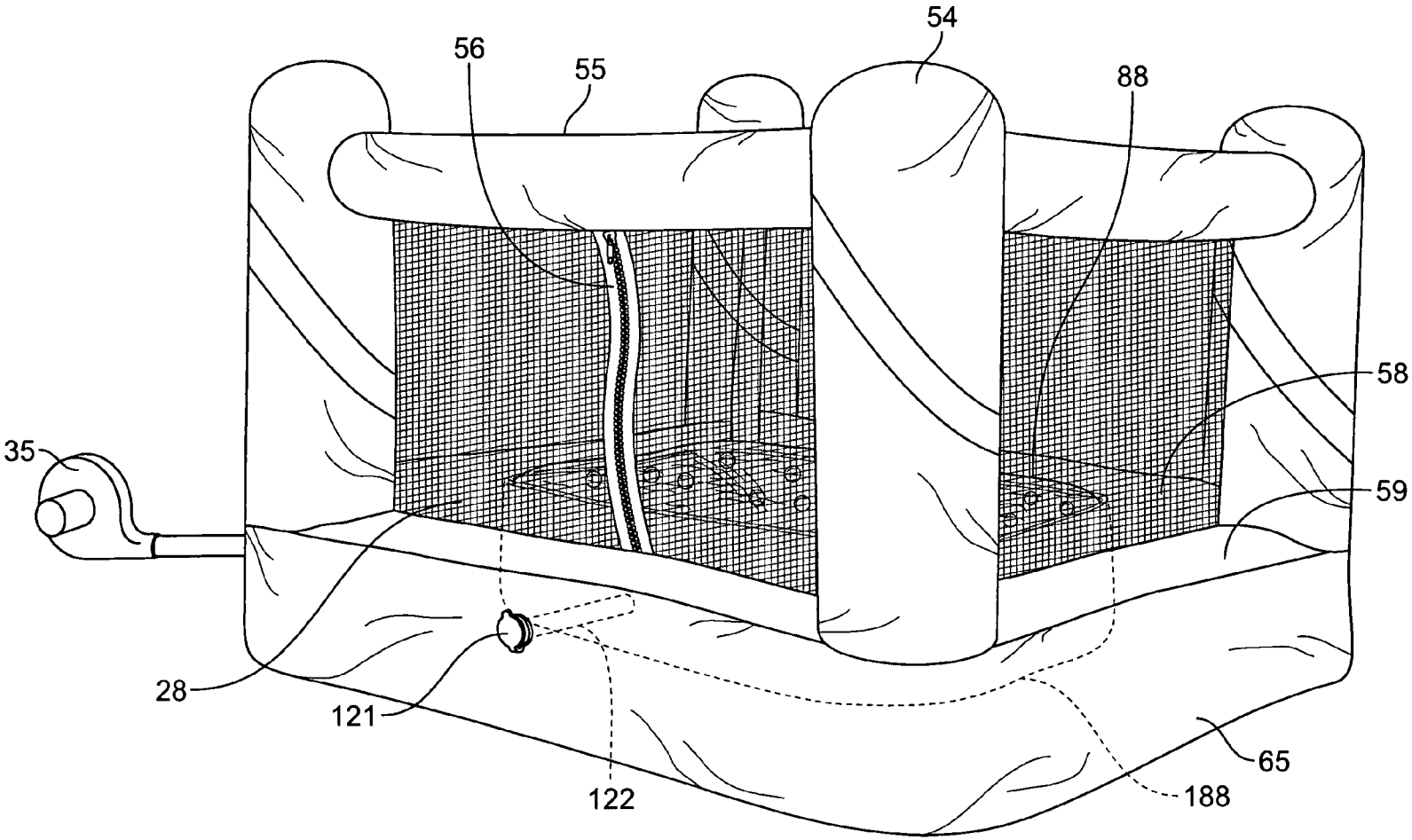
FIG. 2 is a perspective view of the fluid chamber jumper inflatable bounce house embodiment.
Figure 3:
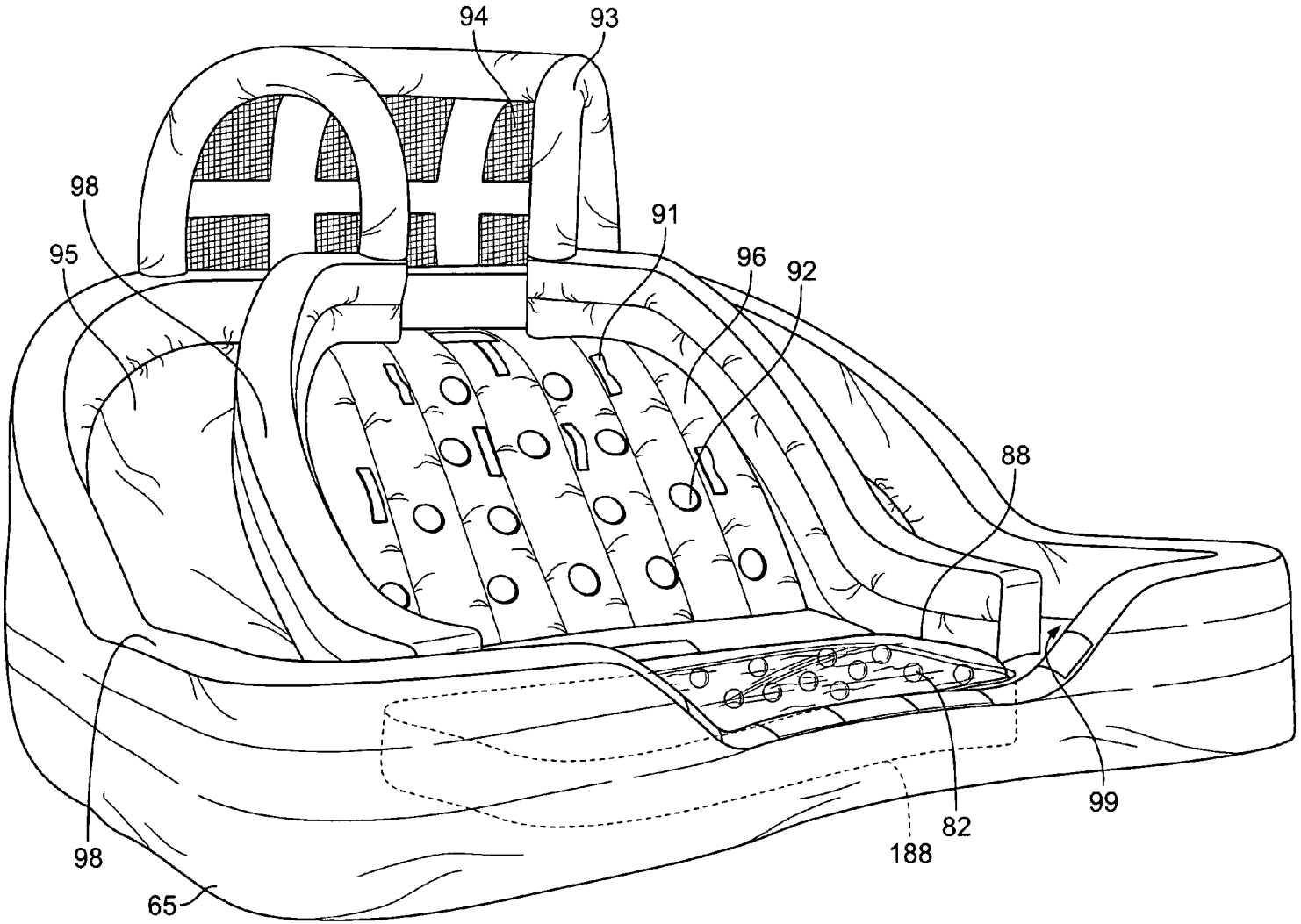
FIG. 3 is a perspective view of the fluid chamber jumper inflatable slide embodiment.

The mesh panels 28 are preferably supported by an inflatable column such as a vertical column 54 disposed in each corner of a bounce house, as seen in the bounce house embodiment FIG. 2. The vertical column preferably coordinates with horizontal inflatable members 55 for creating a bounce house canopy enclosure. The children get into the enclosure through the zippered door 56. The door can also be an unsecured flap, or magnetically secured.

A support pole 74 alternatively supports the mesh panels 28, FIG. 1. The support pole 74 is preferably constructed of a hollow tube of steel or fiberglass and wrapped with a plastic foam cushion covering. The support pole when implemented in a trampoline configuration, provides a trampoline mesh panel 78 which encloses a trampoline bed 71 that is suspended across a trampoline frame 72. For safety, a trampoline skirt 73 extends between supporting legs of the trampoline frame 72. The trampoline embodiment provides a trampoline area, and a fluid chamber bounce area. The entry to the trampoline bed 71 is over the fluid chamber 88.

The fluid chamber 88 fits into a fluid chamber pocket 188 that is formed into the side air chamber 65. The side air chamber 65 has a depression to form a pocket for receiving the fluid chamber 88 such that the weight of the fluid chamber rests on the ground and retains the side air chamber 65 to the ground. The fluid chamber 88 stabilizes the side air chamber 65 with its water weight. The side air chamber 65 preferably has a bottom panel that is not inflated, but which extends underneath the fluid chamber, and extends between the walls of the side air chamber. The fluid chamber 88 presses down on the bottom panel, which is connected to and therefore retains the entire apparatus. The fluid chamber 88 can have subchambers that are not in fluid connection to each other, however it is operable to have the fluid chamber 88 in a single chamber configuration.

A water passage 122 may be formed through the side air chamber 65, through the fluid chamber pocket 188 for filling and discharging water in the fluid chamber 88. A fill tube on

21 connected to the fluid chamber 88 allows a user to drain and fill the fluid chamber preferably with a garden hose connection or other type of hose connection. A hose connection can be used to fill the chamber from a water source. The hose connection can also be used to drain the chamber back to the water source, or for distributing the water over the lawn to avoid puddles. When the apparatus is set up, the operator initially sets up the apparatus with the side air chamber 65 and inflates it, then lays an empty watertight fluid chamber 88 in the fluid chamber pocket 188, then fills the fluid chamber 88 so that the weight of the water conforming to the fluid chamber pocket 188 lodges the fluid chamber 88 within the fluid chamber pocket 188. After the event, the operator may leave the apparatus in place for the next event, or drain the fluid chamber through the fill tube 121 and remove the fluid chamber 88 before stowing the side air chamber. By filling and draining the fluid chamber, the operator converts the apparatus from a filled configuration to an empty configuration.

Optionally, the operator may spray water over the fluid chamber 88, which can retain a small layer of water over the fluid chamber, for evaporative cooling of children. A hose connection can also be secured to the top of the canopy for spraying down the ramp, down the slide, or around the area of the enclosure.

Figure 4:
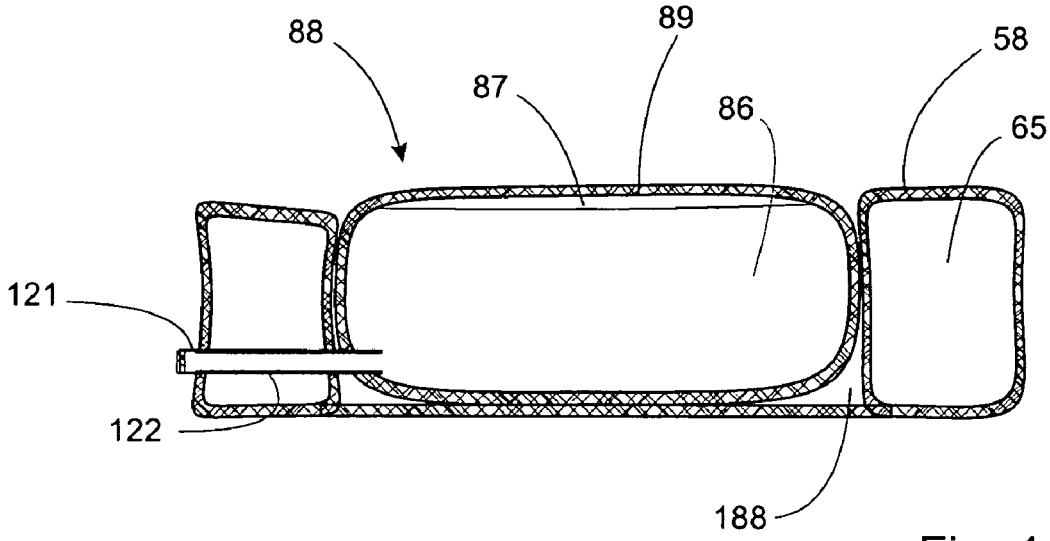
FIG. 4 is a cross-section view of the fluid chamber and supporting side air chamber.

For additional clarity, FIG. 4 shows a cross-section of the fluid chamber pocket 188. The fluid chamber pocket has a bottom panel resting on the ground, and the fluid chamber 88 rests on the bottom panel.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. An inflatable apparatus comprising:

a. a fluid chamber;

b. an inflatable side air chamber surrounding the fluid chamber, wherein the inflatable side air chamber forms a fluid chamber pocket for receiving the fluid chamber, wherein a side wall of the inflatable side air chamber supports the fluid chamber when the fluid chamber is in a filled configuration;

c. retaining walls extending upward from the inflatable side air chamber, and wherein the fluid chamber has a top panel; and d. a ramp adjacent to the fluid chamber, wherein the ramp leads to a slide for sliding to a slide exit, wherein the ramp is inflatable.

2. The inflatable apparatus of claim 1, further comprising: hand grips formed as straps mounted on the ramp; and footholds formed on the ramp, wherein the retaining walls are inflatable sidewalls, extending upward from the inflatable side air chamber which is shaped to form a body of the slide.

3. The inflatable apparatus of claim 1, further comprising: a canopy mounted to the top of the ramp, wherein the canopy is made of inflatable structure having openings; and canopy mesh extending between the openings of the inflatable structure of the canopy.

4. An inflatable apparatus comprising:

a. a fluid chamber;

b. an inflatable side air chamber surrounding the fluid chamber, wherein the inflatable side air chamber forms a fluid chamber pocket for receiving the fluid chamber, wherein a side wall of the inflatable side air chamber supports the fluid chamber when the fluid chamber is in a filled configuration;

c. retaining walls extending upward from the inflatable side air chamber, and wherein the fluid chamber has a top panel; and d. a trampoline frame attached to the side air chamber; and a trampoline bed stretched across the trampoline frame.

5. The inflatable apparatus of claim 4, further comprising: a plurality of support poles extending upward from the trampoline frame; and a plurality of trampoline mesh panels extended between the support poles.

6. The inflatable apparatus of claim 4, wherein the retaining walls are formed as mesh panels extending upward from the side air chamber.

* * * * *